US010463904B1

(12) United States Patent
Bright

(10) Patent No.: US 10,463,904 B1
(45) Date of Patent: Nov. 5, 2019

(54) EXERCISE DEVICE

(71) Applicant: Dwayne Bright, Henderson, NV (US)

(72) Inventor: Dwayne Bright, Henderson, NV (US)

( * ) Notice: Subject to any disclaimer, the term of this patent is extended or adjusted under 35 U.S.C. 154(b) by 325 days.

(21) Appl. No.: 15/407,386

(22) Filed: Jan. 17, 2017

(51) Int. Cl.
*A63B 21/04* (2006.01)
*A63B 21/055* (2006.01)
*A63B 21/00* (2006.01)
*A63B 23/12* (2006.01)

(52) U.S. Cl.
CPC ..... *A63B 21/0442* (2013.01); *A63B 21/0557* (2013.01); *A63B 21/4035* (2015.10); *A63B 23/12* (2013.01)

(58) Field of Classification Search
None
See application file for complete search history.

(56) References Cited

U.S. PATENT DOCUMENTS 3,636,946 A * 1/1972 Hardy ..... A61H 15/00 482/123
D371,176 S 6/1996 Furner
5,810,702 A 11/1998 Wilkinson
6,245,001 B1 * 6/2001 Siaperas ..... A63B 21/04 482/123
6,558,301 B1 * 5/2003 Jackson ..... A63B 21/0552 482/121
6,634,998 B2 * 10/2003 Siaperas ..... A63B 21/04 482/123
6,908,417 B2 * 6/2005 Jackson ..... A63B 21/0552 482/123
7,044,901 B2 * 5/2006 Weir ..... A63B 21/078 482/142
7,591,763 B1 9/2009 Fucci
7,651,452 B2 1/2010 Weir
7,780,585 B1 8/2010 Rivas
8,088,050 B2 1/2012 Aucamp
2002/0160891 A1 * 10/2002 Gallagher ..... A63B 21/04 482/123
2005/0020418 A1 * 1/2005 Lin ..... A63B 21/0552 482/142
2006/0128540 A1 * 6/2006 Engle ..... A63B 21/04 482/123
2006/0135329 A1 * 6/2006 Owen ..... A63B 21/04 482/123
2006/0142129 A1 * 6/2006 Siaperas ..... A63B 21/04 482/142
2008/0058165 A1 3/2008 Schletti

FOREIGN PATENT DOCUMENTS

WO 2010056959 A2 5/2010

* cited by examiner

*Primary Examiner* — Stephen R Crow

(57) ABSTRACT

The exercise device is adapted for use in resistance training. The exercise device is adapted for use with an exerciser. The exercise device comprises an anchor block and a plurality of resistance straps. Each individual resistance strap selected from the plurality of resistance straps is an elastic spring like device. The selected individual resistance strap provides a counterforce to an exerciser that is deforming the selected individual resistance strap through the use of tension. Each individual resistance strap is anchored to the anchor block. The anchor block is a rectilinear structure. The exerciser sits upon or pushes against the anchor block such that the weight of the exerciser in combination with the exercises performed will hold the anchor block in position during an exercise session.

9 Claims, 4 Drawing Sheets

EXERCISE DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of health and amusement, more specifically, an apparatus for developing or strengthening muscles or joints by working against a counterforce.

SUMMARY OF INVENTION

The exercise device is adapted for use in resistance training. The exercise device is adapted for use with an exerciser. The exercise device comprises an anchor block and a plurality of resistance straps. Each individual resistance strap selected from the plurality of resistance straps is an elastic spring like device. The selected individual resistance strap provides a counterforce to an exerciser that is deforming the selected individual resistance strap through the use of tension. Each individual resistance strap is anchored to the anchor block. The anchor block is a rectilinear structure. The exerciser sits upon or pushes against the anchor block such that the weight of the exerciser in combination with the exercises performed will hold the anchor block in position during an exercise session.

These together with additional objects, features and advantages of the exercise device will be readily apparent to those of ordinary skill in the art upon reading the following detailed description of the presently preferred, but nonetheless illustrative, embodiments when taken in conjunction with the accompanying drawings.

In this respect, before explaining the current embodiments of the exercise device in detail, it is to be understood that the exercise device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the exercise device.

It is therefore important that the claims be regarded as including such equivalent construction insofar as they do not depart from the spirit and scope of the exercise device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
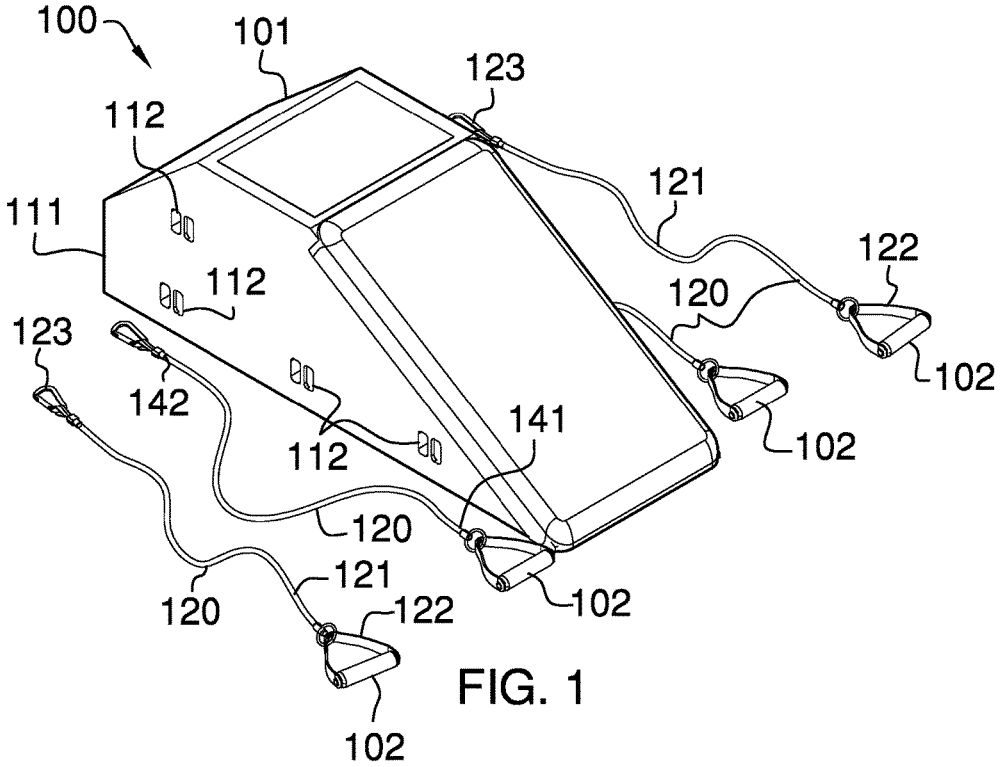
FIG. 1 is a perspective view of an embodiment of the disclosure.
Figure 2:
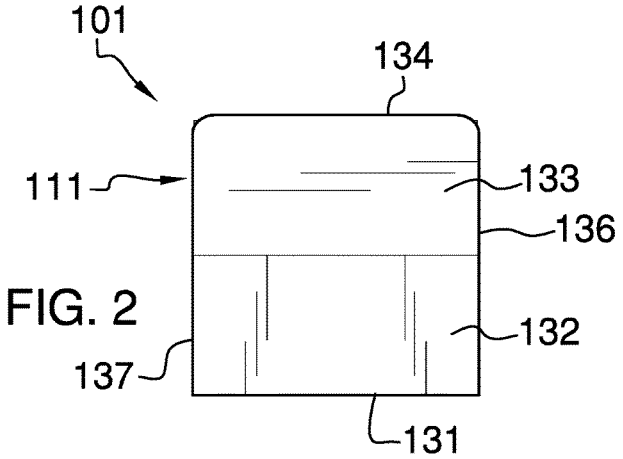
FIG. 2 is a rear view of an embodiment of the disclosure.
Figure 3:
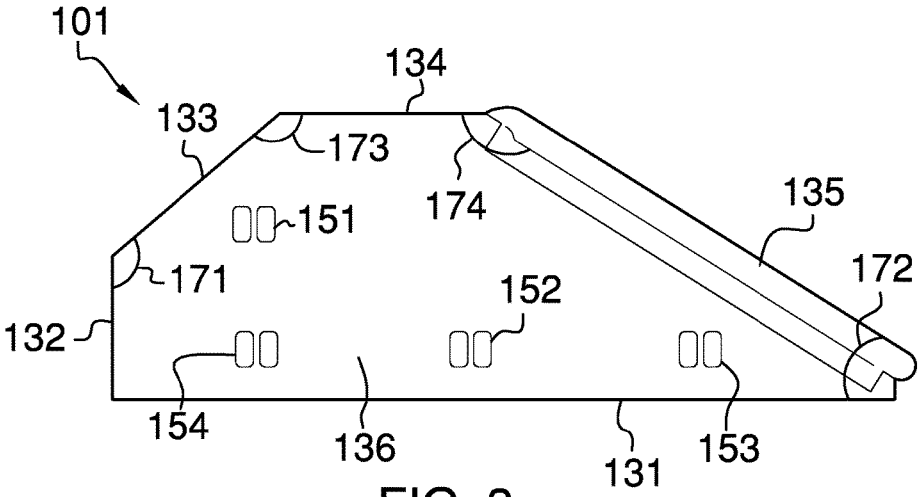
FIG. 3 is a side view of an embodiment of the disclosure.
Figure 4:
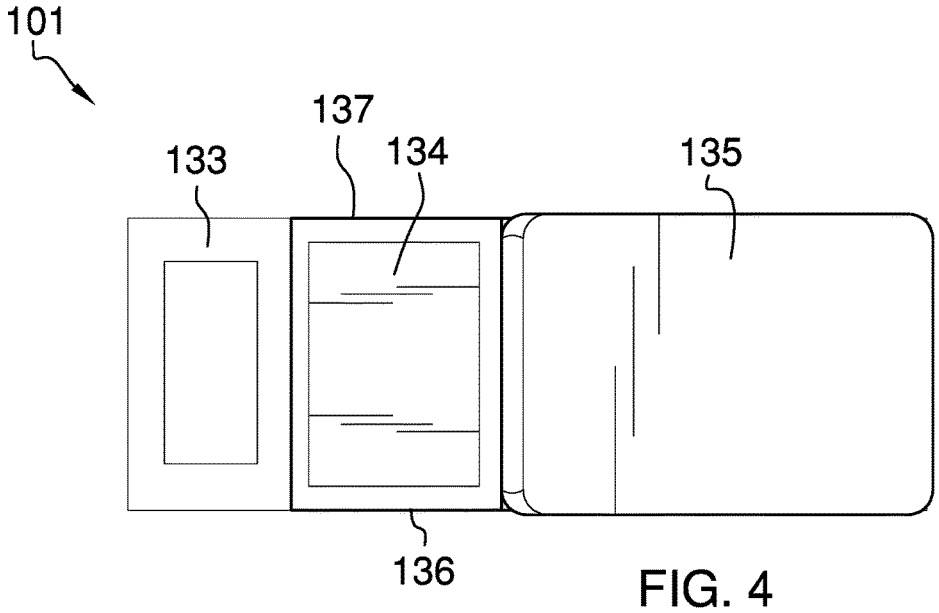
FIG. 4 is a top view of an embodiment of the disclosure.
Figure 5:
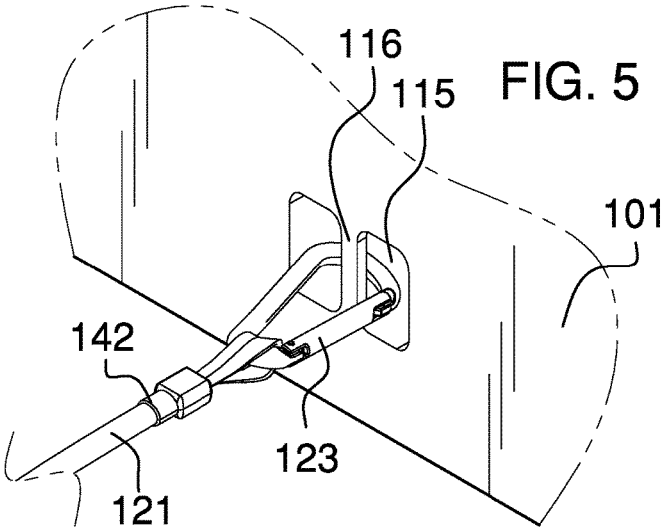
FIG. 5 is a detail view of an embodiment of the disclosure.
Figure 6:
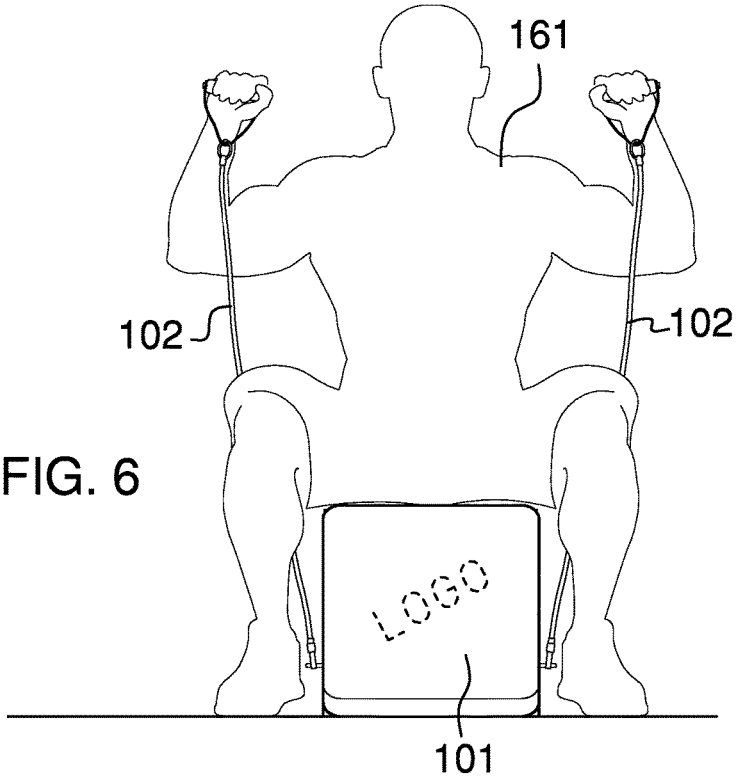
FIG. 6 is an in use view of an embodiment of the disclosure.
Figure 7:
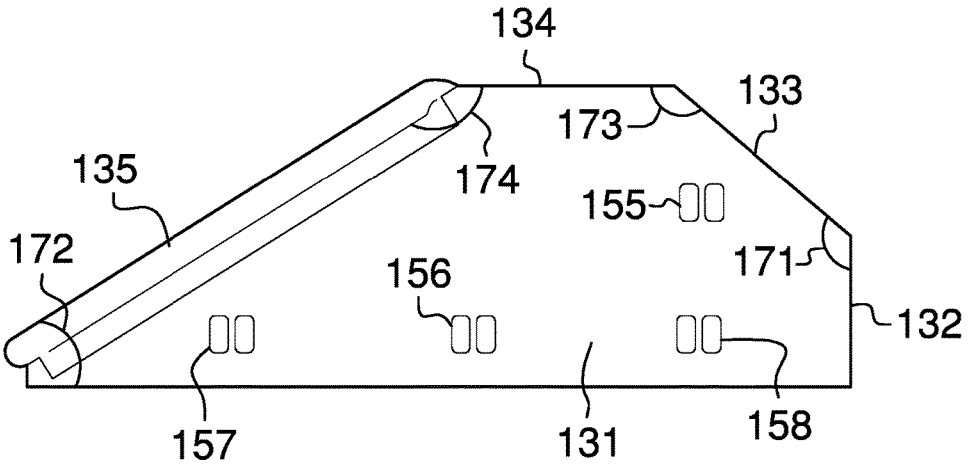
FIG. 7 is a reverse side view of an embodiment of the disclosure.

Detailed reference will now be made to one or more potential embodiments of the disclosure, which are illustrated in FIGS. 1 through 7.

The exercise device 100 (hereinafter invention) is adapted for use in resistance training. The invention 100 is adapted for use with an exerciser 161. The exerciser 161 refers to the person using the invention 100. The invention 100 comprises an anchor block 101 and a plurality of resistance straps 102. Each individual resistance strap 120 selected from the plurality of resistance straps 102 is an elastic spring like device. The selected individual resistance strap 120 provides a counterforce to an exerciser 161 that is deforming the selected individual resistance strap 120 through the use of tension. Each individual resistance strap 120 is anchored to the anchor block 101. The anchor block 101 has a rectilinear structure. The exerciser 161 sits upon or pushes against the anchor block 101 such that the weight of the exerciser 161 in combination with the exercises performed will hold the anchor block 101 in position during an exercise session.

The anchor block 101 is a block structure that forms the foundation of the invention 100. The plurality of resistance straps 102 anchor to the anchor block 101 during use of the invention 100. The anchor block 101 comprises a rectilinear block structure 111 and a plurality of anchor points 112.

The rectilinear block structure 111 is a three dimensional rectilinear structure upon which the plurality of resistance straps 102 are attached. The rectilinear block structure 111 is further defined with a first face 131, a second face 132, a third face 133, a fourth face 134, a fifth face 135, a sixth face 136, and a seventh face 137.

Each of the plurality of anchor points 112 is a location formed in the rectilinear block structure 111 to which an individual resistance strap 120 selected from the plurality of resistance straps 102 is attached. Each of the plurality of anchor points 112 further comprises an anchor cavity 115 and a latch bar 116.

The anchor cavity 115 is a cavity that is formed within a face of the rectilinear block structure 111. The latch bar 116 is a joist that is place across the open face of the anchor cavity 115. The latch bar 116 is the physical attachment point to which the individual resistance strap 120 is attached.

The plurality of anchor points 112 further comprises a first anchor point 151, a second anchor point 152, a third anchor point 153, a fourth anchor point 154, a fifth anchor point 155, a sixth anchor point 156, a seventh anchor point 157, and an eight anchor point 158. The first anchor point 151, the second anchor point 152, the third anchor point 153, the fourth anchor point 154 are formed in the sixth face 136 of the rectilinear block structure 111. The fifth anchor point 155, the sixth anchor point 156, the seventh anchor point 157, and the eighth anchor point 158 are formed in the seventh face 137 of the rectilinear block structure 111.

The first face 131 is the inferior face of the rectilinear block structure 111. The first face 131 is placed upon the horizontal surface upon which the invention 100 rests. The first face 131 is formed with a rectangular face. The second face 132 is a vertical rectangular face that projects perpendicularly away from the first face 131 in the superior direction. In the first potential embodiment of the disclosure, the second face 132 does not have any of the plurality of anchor points 112 mounted within it.

The third face 133 is a rectangular face that projects away from the second face 132 at a first angle 171. The fourth face 134 is a rectangular face that forms the superior face of the invention 100. The fourth face 134 is parallel to the first face 131. The junction of the fourth face 134 and the third face 133 forms a third angle 173. The fifth face 135 is a rectangular face that attaches the fourth face 134 to the first face 131. The junction of the fifth face 135 and the fourth face 134 forms a fourth angle 174. The fifth face 135 and the first face 131 forms a second angle 172.

The sixth face 136 is a rectilinear face that forms a vertical side of the rectilinear block structure 111. In the first potential embodiment of the disclosure, the sixth face 136 has anchor points selected from the plurality of anchor points 112 formed within it. The sixth face 136 projects perpendicularly away from the first face 131. The seventh face 137 is a rectilinear face that forms a vertical side of the rectilinear block structure 111. In the first potential embodiment of the disclosure, the seventh face 137 has anchor points selected from the plurality of anchor points 112 formed within it. The seventh face 137 projects perpendicularly away from the first face 131.

The first angle 171 refers to the cant formed between the second face 132 and the third face 133. The second angle 172 refers to the cant formed between the first face 131 and the fifth face 135. The third angle 173 refers to the cant formed between the third face 133 and the fourth face 134. The fourth angle 174 refers to the cant formed between the fourth face 134 and the fifth face 135. No angle included within the group consisting of the first angle 171, the second angle 172, the third angle 173, and the fourth angle 174 is a right angle.

Each of the plurality of resistance straps 102 is an elastic structure that provides the counterforce provided by the invention 100 during use of the invention 100. The plurality of resistance straps 102 comprises a collection of individual resistance strap 120. Each individual resistance strap 120 selected from the plurality of resistance straps 102 comprises an elastic strap 121, a handle 122, and a carabiner 123. The elastic strap 121 is further defined with a first end 141 and a second end 142. In the first potential embodiment of the disclosure, the elastic strap 121 is formed using commercially available surgical tubing.

The individual resistance strap 120 is a spring based structure that: 1) is attached to the anchor block 101; and, 2) generates the counterforce provided by the invention 100 during use of the invention 100. The elastic strap 121 is a strap that is formed from an elastic material. The elongation of the elastic strap 121 by the exerciser 161 generates the counterforce provided by the invention 100 during use of the invention 100. The handle 122 is a readily and commercially available hand grip that is used to grasp the individual resistance strap 120. In the first potential embodiment of the disclosure, the handle 122 is a readily and commercially available hand grip that is commonly marketed as a "D Handle" or a "D grip." The carabiner 123 is a readily and commercially available link that attaches the elastic strap 121 to an anchor point selected from the plurality of anchor points 112. The handle 122 attaches to the first end 141 of the elastic strap 121. The carabiner 123 attaches to the second end 142 of the elastic strap 121.

The carabiner 123 attaches to the anchor block 101 by clipping around the latch bar 116 of an anchor point selected from the plurality of anchor points 112.

The following definitions were used in this disclosure:

Anchor: As used in this disclosure, anchor means to hold an object firmly or securely.

Anchor Point: As used in this disclosure, an anchor point is a location to which a first object can be securely attached to a second object.

Cant: As used in this disclosure, a cant is an angular deviation from one or more reference planes such as a vertical plane or a horizontal plane.

Carabiner: As used in this disclosure, a carabiner is coupling link that is usually formed as an oblong metal ring with one spring hinged side that is used to open and close the ring. Synonyms for carabiner include D-link.

Elastic: As used in this disclosure, an elastic is a material or object that deforms when a force is applied to it and that is able to return to its original shape after the force is removed. A material that exhibits these qualities is also referred to as an elastomeric material.

Handle: As used in this disclosure, a handle is an object by which a tool, object, or door is held or manipulated with the hand.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity.

Rectilinear: As used in this disclosure, rectilinear is an adjective that is used to describe an object that: 1) moves in a straight line or lines; 2) consists of a straight line or lines; 3) is bounded by a straight line or lines; or, 4) is otherwise characterized by a straight line or lines.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape.

Superior: As used in this disclosure, the term superior refers to a directional reference that is parallel to and in the opposite direction of the force of gravity.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An apparatus for developing and strengthening muscles comprising:

wherein the apparatus for developing and strengthening muscles comprises an anchor block and a plurality of resistance straps;

wherein each resistance strap selected from the plurality of resistance straps attaches to the anchor block;

wherein the apparatus for developing and strengthening muscles is adapted for use with an exerciser;

wherein the apparatus for developing and strengthening muscles is adapted for use in resistance training;

wherein each selected individual resistance strap provides a counterforce for exerciser;

wherein the exerciser sits upon or pushes against the anchor block such that the weight of the exerciser in combination with the exercises performed will hold the anchor block in position during an exercise session;

wherein each individual resistance strap selected from the plurality of resistance straps is a spring based device;

wherein each individual resistance strap is anchored to the anchor block;

wherein the anchor block comprises a rectilinear block structure and a plurality of anchor points;

wherein the plurality of anchor points are formed in the surface of the rectilinear block structure;

wherein the rectilinear block structure is a three dimensional rectilinear structure;

wherein the plurality of resistance straps attach to the rectilinear block structure;

wherein the rectilinear block structure is further defined with a first face, a second face, a third face, a fourth face, a fifth face, a sixth face, and a seventh face;

wherein each of the plurality of anchor points is a location formed in the rectilinear block structure to which an individual resistance strap selected from the plurality of resistance straps is attached;

wherein each of the plurality of anchor points further comprises an anchor cavity and a latch bar;

wherein the anchor cavity is a cavity that is formed within a face of the rectilinear block structure;

wherein the latch bar is a joist that is place across the open face of the anchor cavity;

wherein the latch bar is the physical attachment point to which the individual resistance strap is attached;

wherein the first face is the inferior face of the rectilinear block structure;

wherein the first face is placed upon the horizontal surface upon which the apparatus for developing and strengthening muscles rests;

wherein the second face is a first vertical side that projects perpendicularly away from the first face in the superior direction;

wherein the third face projects away from the second face;

wherein the fourth face forms the superior face of the apparatus for developing and strengthening muscles;

wherein the fourth face is parallel to the first face;

wherein the fifth face attaches the fourth face to the first face;

wherein the sixth face forms a second vertical side of the rectilinear block structure;

wherein the sixth face projects perpendicularly away from the first face;

wherein the seventh face forms a third vertical side of the rectilinear block structure;

wherein the seventh face projects perpendicularly away from the first face.

2. The apparatus for developing and strengthening muscles according to claim 1 wherein the first face is formed with a rectangular face;

wherein the second face is a rectangular face;

wherein the third face is a rectangular face;

wherein the fourth face is a rectangular face;

wherein the fifth face is a rectangular face;

wherein the sixth face is a rectilinear face;

wherein the seventh face is a rectilinear face.

3. The apparatus for developing and strengthening muscles according to claim 2 wherein the junction of the third face and the second face forms a first angle;

wherein the junction of the first face and the fifth face forms a second angle;

wherein the junction of the fourth face and the third face forms a third angle;

wherein the junction of the fifth face and the fourth face forms a fourth angle.

4. The apparatus for developing and strengthening muscles according to claim 3 wherein the first angle refers to the cant formed between the second face and the third face;

wherein the second angle refers to the cant formed between the first face and the fifth face;

wherein the third angle refers to the cant formed between the third face and the fourth face;

wherein the fourth angle refers to the cant formed between the fourth face and the fifth face.

5. The apparatus for developing and strengthening muscles according to claim 4 wherein no angle included within the group consisting of the first angle, the second angle, the third angle, and the fourth angle is a right angle.

6. The apparatus for developing and strengthening muscles according to claim 5 wherein the sixth face has one or more anchor points selected from the plurality of anchor points formed within it;

wherein the seventh face has one or more anchor points selected from the plurality of anchor points formed within it.

7. The apparatus for developing and strengthening muscles according to claim 6 wherein the plurality of resistance straps comprises a collection of individual resistance straps;

wherein each individual resistance strap selected from the plurality of resistance straps comprises an elastic strap, a handle, and a carabiner;

wherein the elastic strap is further defined with a first end and a second end;

wherein the handle attaches to the first end of the elastic strap;

wherein the carabiner attaches to the second end of the elastic strap.

8. The apparatus for developing and strengthening muscles according to claim 6 wherein the elastic strap is formed from an elastic material;

wherein the elongation of the elastic strap by the exerciser generates the counterforce provided by the apparatus for developing and strengthening muscles during use of the apparatus for developing and strengthening muscles;

wherein the handle is a hand grip that is used to grasp the individual resistance strap;

wherein the carabiner is a link that attaches the elastic strap to an anchor point selected from the plurality of anchor points;

wherein the carabiner attaches to the anchor block by clipping around the latch bar of an anchor point selected from the plurality of anchor points.

9. The apparatus for developing and strengthening muscles according to claim 8 wherein the elastic strap is formed using surgical tubing.

* * * * *